US007481517B2

(12) United States Patent
Wijshoff

(10) Patent No.: US 7,481,517 B2
(45) Date of Patent: Jan. 27, 2009

(54) INKJET PRINTER

(75) Inventor: Hermanus M. A. Wijshoff, Grevenbicht (NL)

(73) Assignee: Oce-Technologies B.V., Venlo (NL)

( * ) Notice: Subject to any disclaimer, the term of this patent is extended or adjusted under 35 U.S.C. 154(b) by 373 days.

(21) Appl. No.: 11/392,699

(22) Filed: Mar. 30, 2006

(65) Prior Publication Data

US 2006/0221150 A1 Oct. 5, 2006

(30) Foreign Application Priority Data

Mar. 31, 2005 (EP) ..... 05102536

(51) Int. Cl.
*B41J 2/14* (2006.01)
*B41J 2/16* (2006.01)

(52) U.S. Cl. ..... 347/47; 347/65; 347/94

(58) Field of Classification Search ..... 347/20, 347/44, 47, 65, 67, 92–94, 68, 70–72
See application file for complete search history.

(56) References Cited

U.S. PATENT DOCUMENTS 4,216,477 A * 8/1980 Matsuda et al. ..... 347/45
4,317,124 A 2/1982 Shirato et al. ..... 347/67
4,418,355 A 11/1983 DeYoung et al. ..... 347/70
4,525,728 A * 6/1985 Koto ..... 347/70
5,988,798 A * 11/1999 Hirasawa et al. ..... 347/65

FOREIGN PATENT DOCUMENTS

| | | | |
|---|---|---|---|
| EP | 0 314 486 | A2 | 5/1989 |
| EP | 0 636 481 | A2 | 2/1995 |
| EP | 0 822 080 | | 2/1998 |
| JP | 1-148561 | A | 6/1989 |

OTHER PUBLICATIONS

Utsumi et al., IMC, Proceedings, 1986, pp. 36-42.

* cited by examiner

*Primary Examiner*—Juanita D Stephens
(74) *Attorney, Agent, or Firm*—Birch, Stewart, Kolasch & Birch, LLP

(57) ABSTRACT

An inkjet printer for jetting ink that is substantially free of solvent, the printer containing a printhead having an ink chamber with an ink inlet and an ink outlet, an ink supply reservoir in fluid connection with the chamber via the ink inlet, an electromechanical transducer in operative connection with the ink chamber for generating pressure waves herein, and a heater for substantially uniformly heating the ink in the ink chamber, wherein the ink inlet includes a constricting element such that the pressure drop over the constricting element in the direction from the reservoir to the chamber is smaller than the pressure drop over said element in the opposite direction for the same net fluid flow and wherein the ratio of the length of the constricting element and the mean diameter of the constricting element is less than 10.

4 Claims, 3 Drawing Sheets

3

INKJET PRINTER

This application claims priority to European Application No. 05102536.9 filed on Mar. 31, 2005 in the European Patent Office, the entire contents of which is hereby incorporated by reference in its entirety.

BACKGROUND OF THE INVENTION

The present invention pertains to an inkjet printer for jetting ink that is substantially free of solvent, the printer comprising a printhead having an ink chamber with an ink inlet and an ink outlet, an ink supply reservoir in fluid connection with the chamber via the ink inlet, an electromechanical transducer in operative connection with the chamber for generating pressure waves therein, and a heater for substantially, uniformly heating the ink in the ink chamber, wherein the ink inlet comprises a constricting element.

Such an inkjet printer is known from U.S. Pat. No. 4,418,355 (DeYoung, 1983). This printer is designed for jetting inks that are substantially free of solvent, i.e., inks that dry or harden on the receiving medium without the need of large amounts of solvent to evaporate from the jetted ink. Typically these inks contain less than 10% of material that is not included in the ultimate dried ink. Developments in the field of these inks has resulted in inks that contains less than 5% or even less than 2% (ultimately approaching zero %) of material that will not be included in the dried ink. Hot melt inks and UV curable inks are typical examples of such inks. In the rest of this description, these inks will be referred to as solvent free inks.

Solvent free inks typically have a viscosity that is substantially higher than the viscosity of solvent inks. In order to be able and jet small drops of these inks out of the outlet (nozzle) of the ink chamber it is therefore required that the ink is heated to an elevated temperature. In order to provide for a stable jetting process, the inkjet head comprises a heating element for substantially uniformly heating the ink in the ink chamber. This is in complete contrast with the known bubble jet printheads which have heaters for locally heating the ink in the chamber. Such local heating may give rise to temperature gradients in the chamber itself amounting up to 40° C. In the head as known from the prior art, the temperature gradient in an ink chamber will be less than 10° C. In equilibrium circumstances this will be even less than 5° C., and most probably even less than 2° C.

As apparent from FIG. 3 of the above mentioned U.S. patent, the ink chamber is connected to an ink reservoir via an inlet comprising a constricting element. In this way, it is substantially prevented that pressure waves generated by actuating the electromechanical transducer (see FIG. 1), propagate via the reservoir to neighboring ink chambers. Such propagation induces cross-talk and produces print artefacts.

The known printhead however has an important disadvantage. Due to the fact that solvent free inks have a relatively high viscosity (even at the operating temperature of the printhead these are typical 10-15 mPa·s), the restriction in the inlet constitutes an inherent high resistance against free flow of ink from the reservoir to the ink chamber. Therefore, the restriction is bound to certain minimum dimensions depending among other things on the actual viscosity of the ink and the driving frequency of the electromechanical transducer. This means that the resistance against propagation of pressure waves is not optimal. When the integration density of the nozzles is made higher, and even more so, when the driving frequency becomes higher than 5 kHz, this disadvantage becomes even more pronounced.

Accordingly, it is an object of the present invention to overcome or at least mitigate this problem. To this end, an inkjet printhead has been developed, wherein the constricting element is such that the pressure drop over the constricting element in the direction from the reservoir to the chamber is smaller than the pressure drop over said element in the opposite direction for the same net fluid flow and wherein the ratio of the length of the constricting element and the mean diameter of this element is less than 10.

SUMMARY OF THE INVENTION

It has been surprisingly found that the flow of the ink through the constricting element is substantially less hindered when compared to the straight constricting element as known from the prior art, even when the inkjet printhead has ink chambers with very small dimensions and is operated with frequencies well above 5 kHz. Apparently, in the inkjet printhead of the present invention, the constricting element induces a flow directing effect from the reservoir to the ink chamber. This means that a constriction can be chosen having very small dimensions without inducing a deficient supply of ink from the reservoir to the ink chamber. It should be clear that many different shapes can be devised for the constricting element as long as it is provided that the difference in pressure drop and aspect ratio are as stated hereinabove. Apparently, an aspect ratio of less than 10 provides for an additional positive effect on the flow of the ink, which effect seems only be noticeable when the dimensional and operational limits of the inkjet printhead are being reached. It should be noted that the mean diameter means the diameter of a perfect cylinder having the same length and volume as the actual constricting element.

Shapes that could be adequately used according to the present invention have in common that they are asymmetrical in the direction of flow, e.g., constituting a divergent conduit. For the latter shape, there are two main types of geometries, namely conical and flat wall. A conical conduit has an increasing circular cross-section in the direction of the ink flow, whereas the flat wall type has a rectangular cross section with four flat walls of which two are generally parallel and two are divergent. The selection for the type of constricting element depends, among other things, on the type of manufacturing process of the printhead.

It is noted that from the proceedings of the IMC held in Kobe, May 28-30, in 1986, pages 36-42 (lecture by Kazuaki Utsumi et al. NEC Corporation) an inkjet printhead is known having a flat wall type diverging ink chamber inlet. The inkjet printhead disclosed, however, is not designed for the use with solvent free ink jet inks. There are no heating means present to substantially uniformly heat the ink in the ink chamber. From U.S. Pat. No. 4,688,048 there is also known an inkjet printhead having a diverging ink chamber inlet constriction. However, the inlet is symmetrical in the direction of ink flow and thus induces no net ink flow in the direction of the ink chamber. In addition, the printhead is not devised for use with solvent free ink.

In an embodiment of the present invention the length of the constricting element is less than 500 micrometers. This embodiment appears to be a further improvement of the printhead according to the present invention. The reasons for this may be related to the fact that a shorter constricting element inherently has a lower resistance against fluid flow. In a further embodiment the length of the constricting element is less than 100 micrometer which remarkably improves the flow stimulating effect of the constricting element according to the present invention.

In yet another embodiment, the ratio of the length of the constricting element and the diameter of the ink chamber is less than 5. This appears to be a further improvement of the printhead according to the present invention. It is noted that the diameter of the ink chamber means a diameter of a perfect cylinder having the same length and volume as the actual ink chamber.

BRIEF DESCRIPTION OF THE DRAWINGS

The present invention will now be further explained in accordance with the following drawings and examples given hereinbelow.

DETAILED DESCRIPTION OF THE INVENTION

Figure 1:
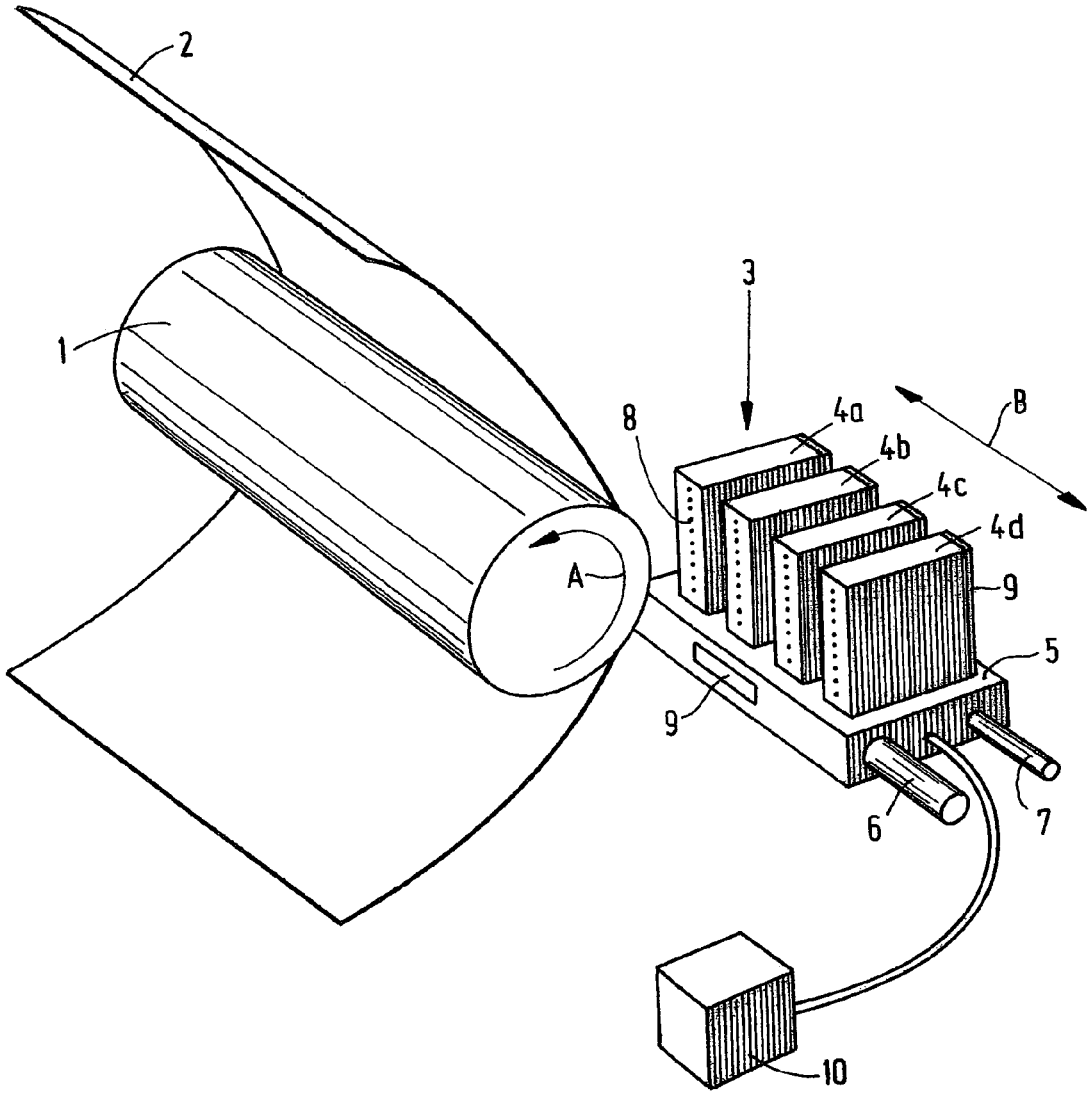
FIG. 1 diagrammatically illustrates an inkjet printer.

FIG. 1 diagrammatically illustrates an inkjet printer. In this embodiment, the printer comprises a roller 1 for supporting a receiving material 2, for example a sheet of paper or a transparent sheet to move it along the scanning carriage 3. The carriage comprises a support member 5 on which the four printheads 4*a*, 4*b*, 4*c* and 4*d* are fixed. Each printhead is provided with ink having its own color, in this case respectively cyan (C), magenta (M), yellow (Y) and black (K). The printheads are specially designed for jetting solvent free ink. For this to be possible, the heads are heated by a heater that comprises heating means 9 disposed at the back of each printhead 4 and on the support member 5. These heating means ensure that the temperature of the printheads is high enough to provide for an adequate (low) viscosity of the ink in the ink chambers. The printhead itself is at least partially made of materials with excellent heat conduction such that it is possible for the heater to substantially uniformly heat the ink in the ink chambers (not shown). Temperature sensors (not shown) are also provided. The printheads are maintained at the correct temperature via a control unit 10, by means of which the heating means can be individually actuated in dependence on the temperature measured by the sensors. Since the printheads are subjected to many heating and cooling cycles, the materials of which the printheads are made are well matched with respect to their thermal expansion coefficients. Next to this, all mechanical connections are designed to be able and resist the tensions that are due to the temperature changes.

The roller 1 is rotatable about its axis as indicated by arrow A. In this way, the receiving material can be moved in the sub-scanning direction (X-direction) with respect to the support member 5 and hence also with respect to the printheads 4. The carriage 3 can be moved in reciprocation by suitable drive means (not shown) in a direction indicated by the double arrow B, parallel to the roller 1. For this purpose, the support member 5 is moved over the guide rods 6 and 7. This direction is termed the main scanning direction or Y-direction. In this way the receiving material can be completely scanned with the printheads 4. In the embodiment as shown in the Figure, each printhead 4 comprises a number of print elements each provided with an ink chamber (not shown) having their own nozzle 8. In this embodiment, the nozzles form, for each printhead, one row which extends perpendicularly to the axis of roller 1 (sub-scanning direction). In a practical embodiment of an inkjet printer, the number of ink chambers per printhead will be many times larger and the nozzles are distributed over two or more rows. Each ink chamber is provided with an electromechanical transducer (not shown) whereby the pressure in the ink duct can be suddenly increased so that an ink drop is ejected through the nozzle of the associated chamber in the direction of the receiving material. A device of this kind is, for example, a piezo-electric element. Such a device can be energized image-wise via an associated electrical drive circuit (not shown). In this way an image built up from ink drops can be formed on receiving material 2.

When a receiving material is printed with a printer of this kind, wherein ink drops are ejected by the print elements, said receiving material or a part thereof is (imaginarily) divided up into fixed locations which form a regular field of pixel rows and pixel columns. In one embodiment, the pixel rows are perpendicular to the pixel columns. The resulting separate locations can each be provided with one or more ink drops. The number of locations per unit length in the directions parallel to the pixel rows and pixel columns is termed the resolution of the printed image, for example indicated as 400×600 d.p.i. ("dots per inch"). By actuating a row of nozzles of a printhead of the inkjet printer image-wise when the row moves with respect to the receiving material with displacement of the support member 5, a (part-)image built up from ink drops forms on the receiving material, at least on a strip of a width of the length of the nozzle row.

Figure 2:
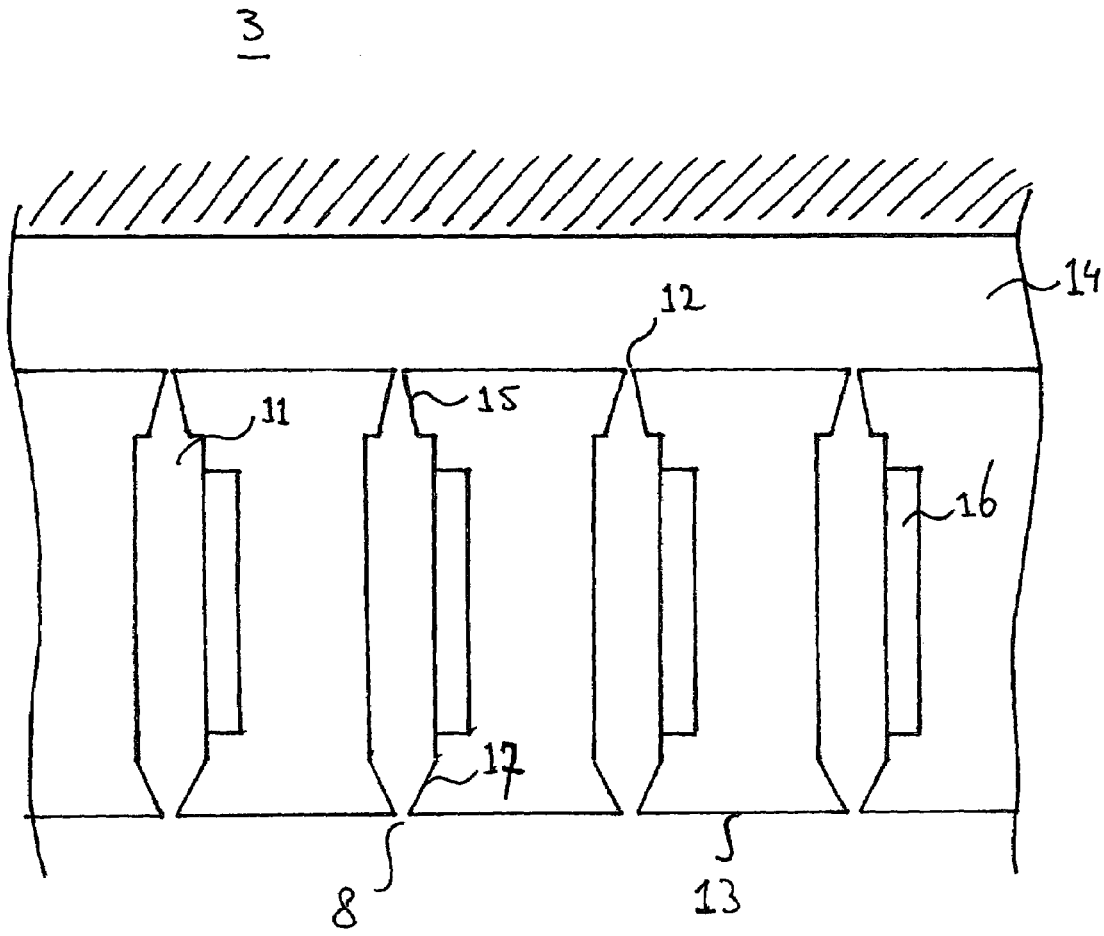
FIG. 2 shows a portion of the piezo-electrically driven inkjet printhead having Helmholtz-type ink chambers.

FIG. 2 schematically shows a portion of the piezo-electrically driven inkjet printhead 3. The portion depicted in FIG. 2 comprises four ink chambers 11 that under operating conditions contain the printing ink, in this case an adequately liquified hot melt ink. At one end of the ink chamber an outlet 17 is provided, which extends between the ink chamber and a nozzle 8 provided for in front end 13 of the ink jet head. At the other end, the ink chamber 11 is connected to an ink supply reservoir 14 which serves to supply the ink chambers with new ink. The individual ink chambers are connected to the ink supply reservoir via an inlet 15 that is formed as a constricting element. The upstream end 12 of the constricting element has a very small opening (5 μm mean diameter) when compared to the diameter of the ink supply reservoir 14 (300 μm), the ink chamber itself (100 μm) and the nozzle opening (30 μm). Each of the ink chambers 11 is connected to a piezo-electric transducer 16. This transducer can be actuated whereupon it shrinks or expands. This way, by transferring that movement to the ink in the corresponding ink chamber, pressure waves can be generated in the ink. As a result of these pressure waves, a droplet of ink can be jetted out of the nozzle. After that, the same amount of ink is fed from ink reservoir 14 to the corresponding ink chamber. The small opening 12 of inlet 15 almost completely prevents the generated pressure waves to propagate to neighbouring ink chambers via the common ink supply reservoir. Still, the supply of ink from the reservoir 14 to each of the ink chambers 11 is not hindered by the small opening 12 of the inlet 15. On the contrary, it appears that the specific design of the constricting inlet, namely a design wherein the pressure drop over this element in the direction from inlet opening 12 to nozzle 8 is smaller than the pressure drop over said element in the opposite direction, provides for a very good ink supply from the reservoir to the ink chamber. The pressure drop over the constricting element can be easily calculated in accordance with the general knowledge in the art of fluid dynamics, for example as explicitly described in Sensors and Actuators A 46-47 (1995) pages 549-556.

Figure 3A:
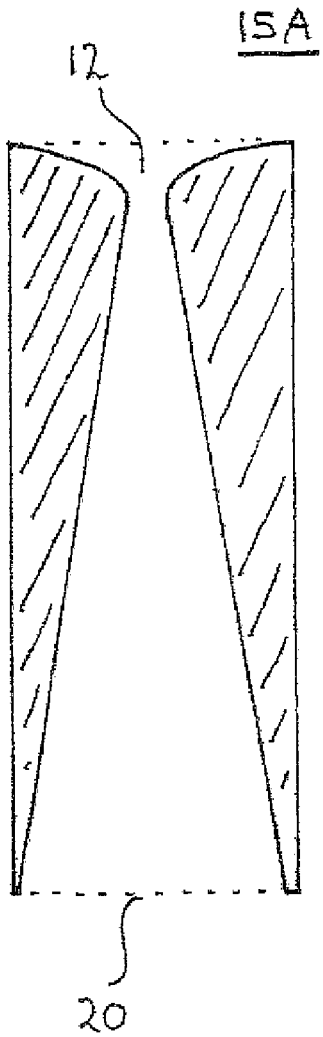
FIGS. 3A and 3B show various types of constricting elements that can be used in the printhead according to the present invention.
Figure 3B:
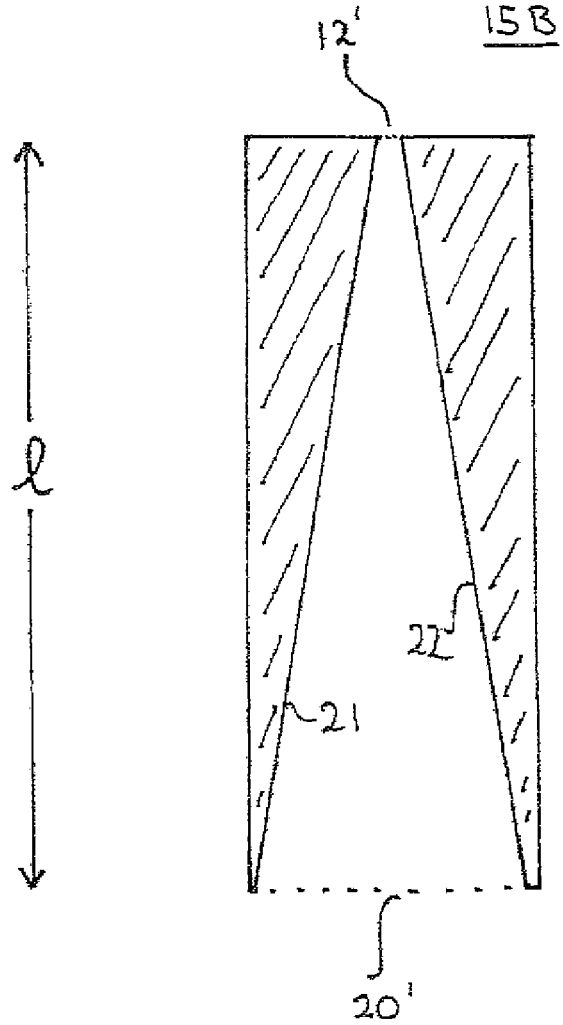

In FIGS. 3A and 3B two examples are given of constricting elements which can be used in the printhead according to the present invention. Both constricting elements have a length $\ell$as indicated of 90 μm. Element 15A is conically shaped (symmetrical around it's axis of length) and has a circular inlet 12 formed as a spout. This inlet has the smallest diameter of 6 μm. The outlet 20 of element 15A has a diameter of 40 μm. The aspect ratio (length divided by mean diameter) of element 15A is thus approximately 4. Element 15B is a flat wall element of which the two diverging walls 21 and 22 are visible. Two flat parallel walls (not shown) close element 15B and provide for a height of 20 μm in the constriction. Opening 12' has a width of 4 μm (and thus the actual measurements of opening 12' are 4×20 μm. Opening 20' has a width of 30 μm (and thus The actual measurements of opening 20' are 30×20 μm. The aspect ratio of element 15B is thus approximately 5.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An inkjet printer for jetting ink that is substantially free of solvent which comprises a printhead having an ink chamber with an ink inlet and an ink outlet, an ink supply reservoir in fluid communication with the ink chamber via the ink inlet, an electromechanical transducer in operative connection with the ink chamber for generating pressure waves in the ink chamber, and a heater for substantially uniformly heating the ink in the ink chamber, wherein the ink inlet comprises a constricting element, such that the pressure drop over the constricting element in the flow direction from the reservoir to the chamber is smaller than the pressure drop over said element in the opposite direction for the same net fluid flow and the ratio of the length of the constricting element and the mean diameter of this element is less than 10.

2. The inkjet printer according to claim 1, wherein the length of the constricting element is less than 500 micrometers.

3. The inkjet printer according to claim 2, wherein the length of the constricting element is less than 100 micrometer.

4. The inkjet printer according to claim 1, wherein the ratio of the length of the constricting element and the diameter of the ink chamber is less than 5.

* * * * *